US007032260B2

(12) United States Patent
Hwang

(10) Patent No.: US 7,032,260 B2
(45) Date of Patent: Apr. 25, 2006

(54) FAUCET WITH A CONNECTING STRUCTURE WITH A COLD AND A HOT WATER PIPE

(76) Inventor: Su Hwang, 3, Gong-Yeh N.3 Road Nankang Ind. Park, Nan-Tou (TW) 540

( * ) Notice: Subject to any disclaimer, the term of this patent is extended or adjusted under 35 U.S.C. 154(b) by 45 days.

(21) Appl. No.: 10/748,252

(22) Filed: Dec. 31, 2003

(65) Prior Publication Data

US 2005/0138725 A1 Jun. 30, 2005

(51) Int. Cl.
*E03C 1/042* (2006.01)

(52) U.S. Cl. ..... 4/695

(58) Field of Classification Search ..... 4/675–678, 4/695–696; 137/801; 285/125.1
See application file for complete search history.

(56) References Cited

U.S. PATENT DOCUMENTS 3,782,417 A * 1/1974 Moen ..... 137/625.17
5,127,110 A * 7/1992 Monch ..... 4/696
5,558,128 A * 9/1996 Pawelzik et al. ..... 137/801
6,421,849 B1 * 7/2002 Gray ..... 4/675

* cited by examiner

*Primary Examiner*—Charles E. Phillips
(74) *Attorney, Agent, or Firm*—Troxell Law Office, PLLC

(57) ABSTRACT

A faucet with a connecting structure with a cold and a hot water pipe includes an inlet base formed in a lower portion. The inlet base has a lateral hole, a cold and a hot water passageway for receiving a cold and a hot water pipe therein and communicating with the lateral hole. A bolt extends pivotally in the lateral hole, having two convex faces to face or leave the water passageways to let two, cold and hot, water pipes to fit in the water passageways and then dead-locked or released by the bolt by means of the outer walls of the two convex faces of the bolt if the bolt is rotated forward or backward for a certain preset angle.

10 Claims, 8 Drawing Sheets

FAUCET WITH A CONNECTING STRUCTURE WITH A COLD AND A HOT WATER PIPE

BACKGROUND OF THE INVENTION

1. Field of the Invention

This invention relates to a faucet with a connecting structure with a cold and a hot water pipe, particularly to one able to easily, quickly and firmly connect with a cold and a hot water pipe by means of rotating a bolt.

2. Description of the Prior Art

Old conventional faucets have had a threadably engaging mode for connecting with a cold and a hot water pipe, with a cold and a hot water pipe together connected with and disconnected from a faucet by rotating. So it took much time and work, very inconvenient.

There is a conventional faucet with a connecting structure with a cold and a hot water pipe disclosed in a Taiwan patent application of No. 088209925, which includes an engage plate and a fix base positioned in its lower portion. The engage plate has a V-shaped hollow with two holes formed at two upper ends, and the fix base has two circular holes respectively aligned to the two holes of the V-shaped hollow. A cold water pipe and a hot water pipe are both provided with an annular groove to match with the annular holes of the fix base and the two holes of the engage plate. When the insert heads of the cold and the hot water pipes are inserted in the V-shaped hollow, the annular grooves of the two water pipes can fit with the two holes of the engage plate so that the two water pipes can pass though the circular holes of the fix base. Then the fix base can push the engage plate against a lower portion of the faucet body tightly and immovable after the insert heads of the water pipes are inserted in the lower portion of the faucet body.

The conventional faucet according to the case of No. 088209925 can deadlock the two water pipes with the faucet body without rotating them, but the whole structure is too complicated and the two water pipes have to be orderly inserted through the circular holes of the fix base and then the two holes of the V-shaped hollow before the engage plate is aligned with the fix base to let the annular grooves of the two pipes are moved laterally to fit with the engage plate, and lastly the fix base is fixed tightly with the lower end surface of the faucet. Thus assembly and disassembly of the two water pipes with the faucet body needs troublesome processes and steps, including screwing the fix plate with the faucet body with screws, inserting the two water pipes from under into the water passageways through the fix base and the engage plate, limited in the workable space under the faucet. So it involves much inconvenience in assembly and disassembly of the two water pipes with the faucet.

SUMMARY OF THE INVENTION

A faucet with a connecting structure with a cold and a hot water pipe in the invention includes an inlet base formed in a lower portion, a bolt, and a multi-claw-shaped gasket and a nut as main components. The inlet base has an upper disc portion and a lower rod portion. The lower rod portion has a lateral hole for the bolt to extend in, and a cold and a hot water passageway formed vertical and both communicating with the lateral hole. The cold and the hot water pipe both have an insert head formed with a position annular groove for the bolt to fit in or leave from and rotated forward and backward for a preset angle to deadlock the two water pipes in place or to release them to be pulled out of the water passageway by a user. And the faucet is quick and easy in combining with the cold and the hot water pipe, with its components being only a few, lowering its cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
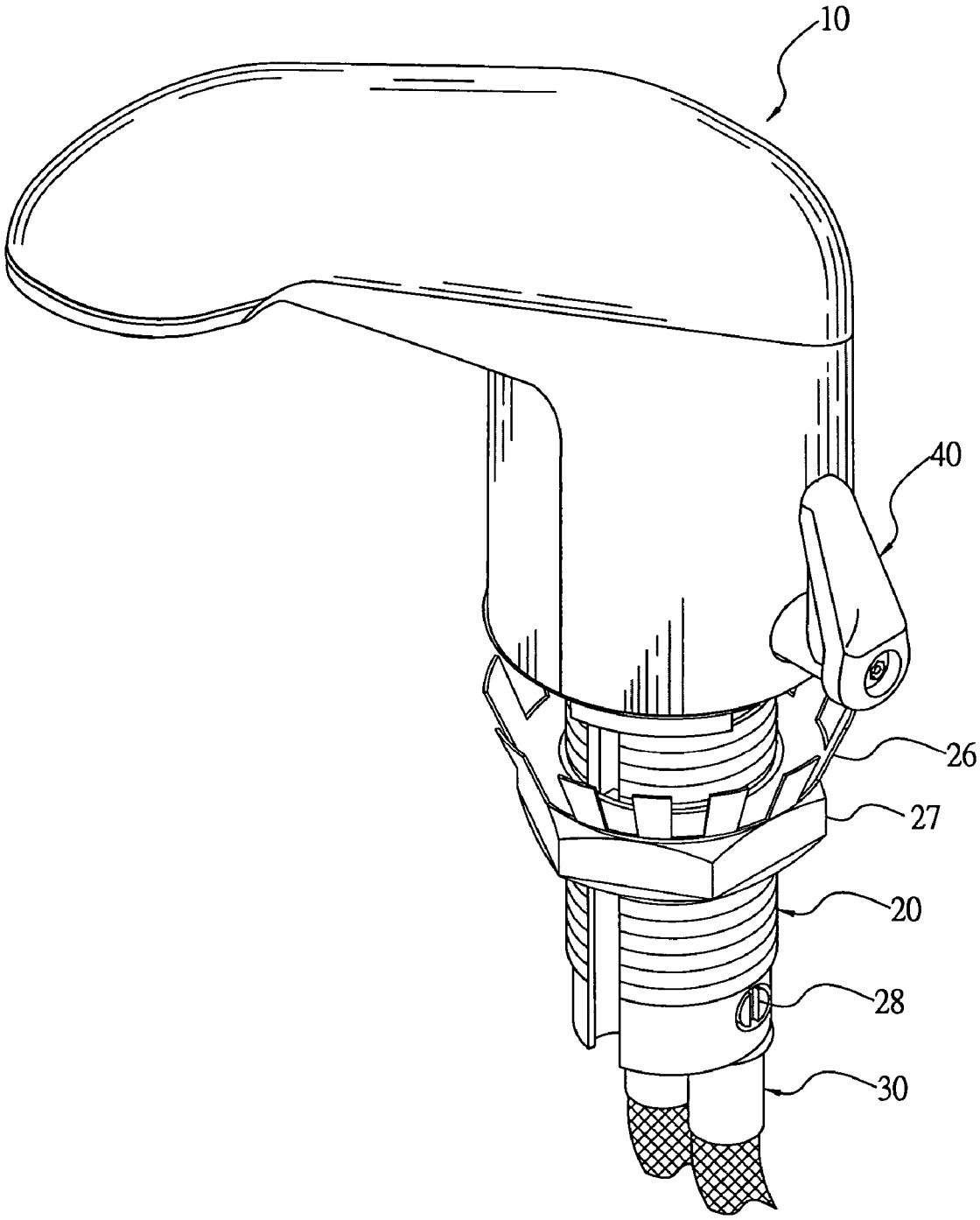
FIG. 1 is a perspective view of a faucet in the present invention.
Figure 2:
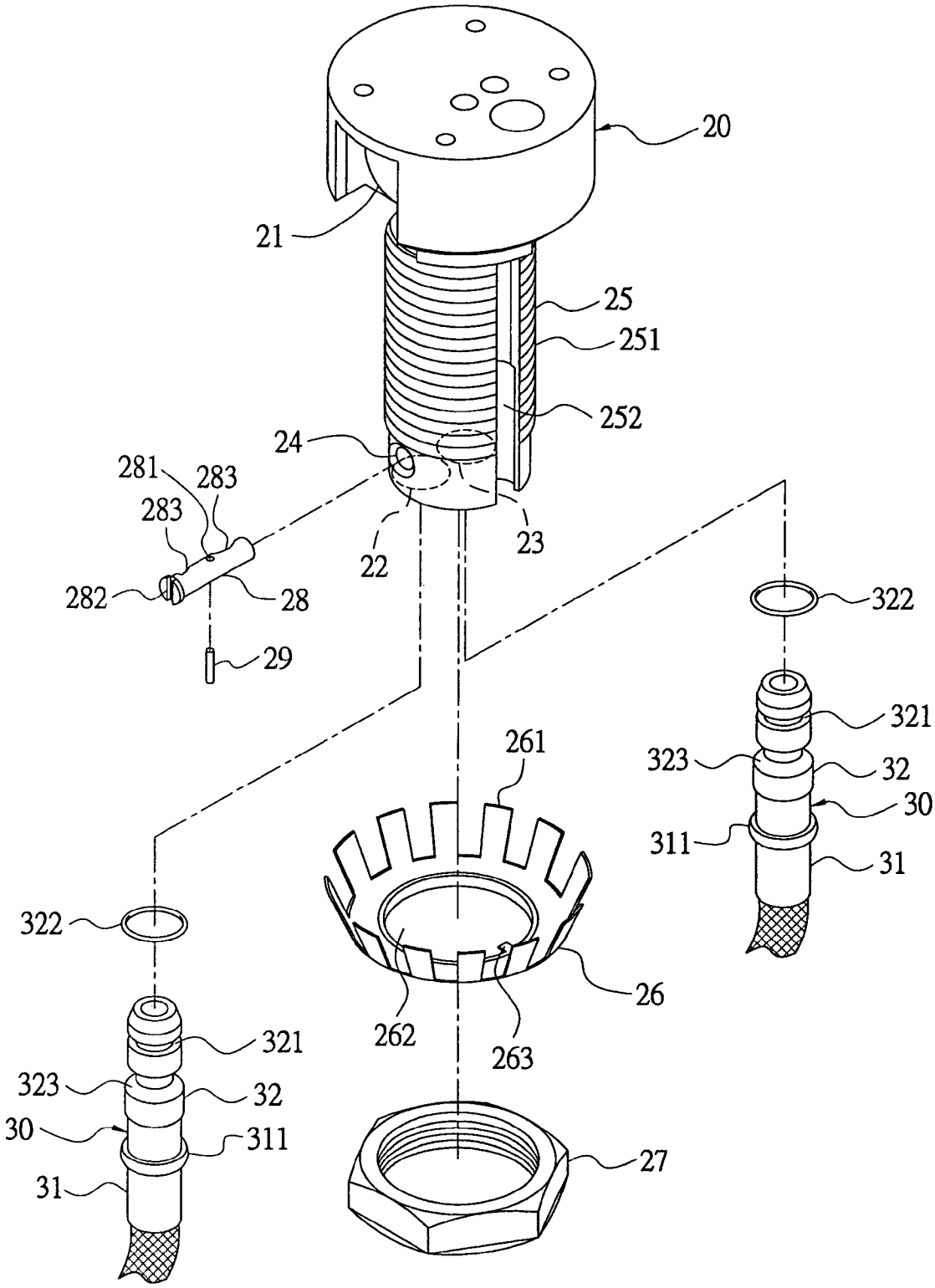
FIG. 2 is an exploded perspective view of the faucet and a cold and a hot water pipe in the present invention.

A first preferred embodiment of a faucet with a connecting structure with a cold and a hot water pipe in the present invention, as shown in FIGS. 1 and 2, includes an upper portion 10 and an inlet base 20 formed in a lower portion to combine with a cold water pipe 30 and a hot water pipe 30, a bolt 28, a multi-claw-shaped gasket 26, a nut 27 and a rotating button 40 as main components.

Figure 5:
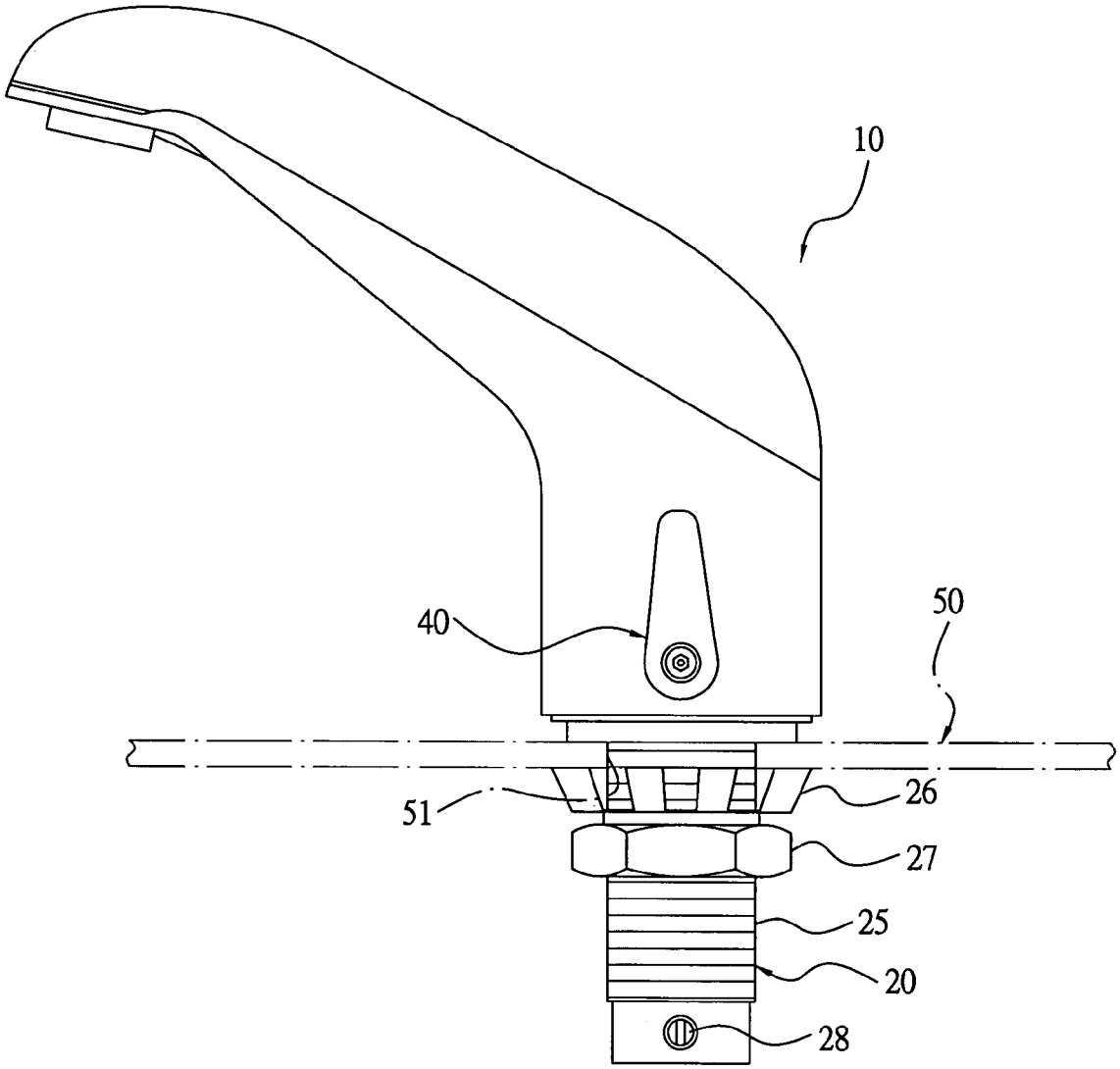
FIG. 5 is a side view of the faucet installed with a sing in the present invention.

The inlet base 20 has an upper disc portion and a lower rod portion with a smaller diameter than that of the upper disc portion, a lateral main hole 21 formed in the upper portion, a cold-water passageway 22 and a hot water passageway 23 formed vertically to communicate with the main hole 21, a lateral hole 24 formed in a lower rod portion to communicate with a proper depth with inner walls of both the cold water and the hot water passageway 22 and 23, a threaded portion 25 formed on the lower rod portion. The lower rod portion fits in a hole 51 of a sink 50 or the like as shown in FIG. 5. The threaded portion 25 has male threads 251 and a vertical groove 252, and the multi-claw-shaped gasket 26 has a center hole 262 and plural claws 261 spaced-apart and extending up from an outer circumference to push against the lower wall surface of the sink 50. Then a position stud 263 is formed to extend inwardly from the center hole 262, inserting movably in the vertical groove 252 to let the multi-claw-shaped gasket 26 move only axially.

Further, the nut 27 screws with the threaded portion 25 so as to push the multi-claw-shaped gasket toward the lower wall surface of the sink 50 for stabilizing the inlet base 20 with the sink 50 firmly.

The bolt 28 extends in the lateral hole 24 of the inlet base 20, having a position semi-circular groove formed in an intermediate portion for a pin 29 to extend and move therein from under the inlet base 20 to limit the bolt 28 to rotate only in the angle of 180 degrees. Further, the bolt 28 has a slot 282 formed in an end face of a head for a proper tool to fit in and rotate for adjusting the angle of the bolt 28, and two convex faces 283 spaced apart respectively on a same side and possible to become flush with an inner wall surfaces of the cold and the hot water pipe 22 and 23 so that the two convex faces 283 may become flush with the inner wall surfaces of the cold and the hot water passageways 22 and 23 when the bolt 28 is rotated for a certain preset angle for adjustment. Then the cold and the hot water passageways 22 and 23 are totally opened, when the bolt 28 is removed from the two passageways 22 and 23. So when the bolt 28 is rotated for 180 degrees in a preset direction, the outer wall surfaces of the two convex faces 283 may move into the two passageways and further fit in a position annular groove 323 of the two water pipes 30 firmly, in other words, deadlock the two water pipes 30 in place.

The cold and the hot water pipe 30 are respectively provided with a constrictor 31 in a lower end, a flange 311 formed at an upper end of the constrictor 31, an insert head 32 formed in an upper end, and an annular groove 321 formed in the insert head 32 with an O-shaped ring 322 fitted around the annular groove 321, and a position annular groove 323 formed below the annular groove 321. After the cold and the hot water pipe 30 are inserted in the cold and the hot water passageway 22 and 23, the flange 311 of the constrictor 31 is stopped by the lower end surface of the inlet base 20, with the position annular groove 323 just positioned to face the convex faces 283 to let the bolt 28 rotatable in the two passageways 22 and 23 so that the two, cold and hot, water pipes can be deadlocked therein or released out thereof.

Figure 4:
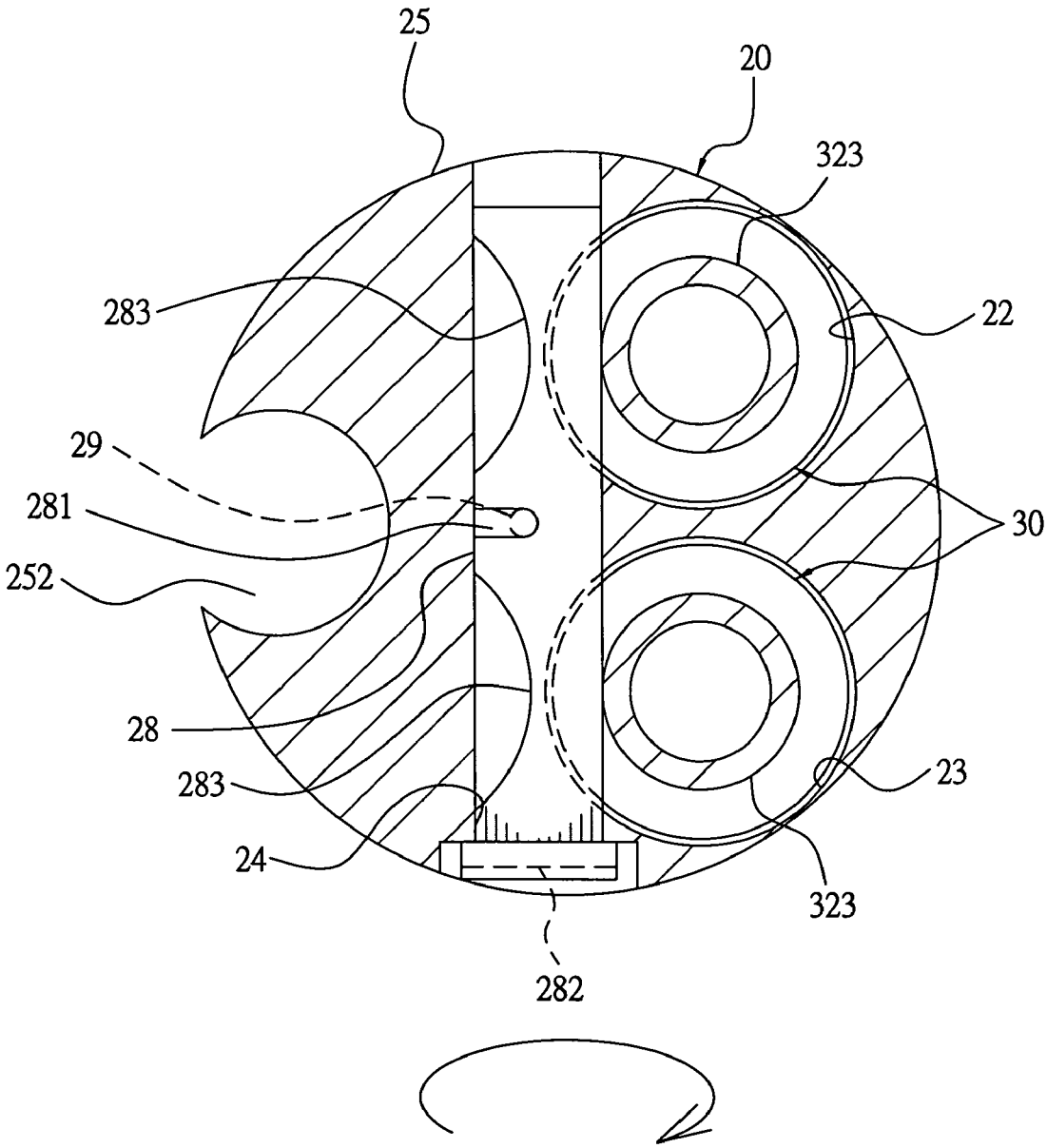
FIG. 4 is a cross-sectional view of the faucet with a cold and a hot water pipe fitted and already deadlocked in the present invention.

In assembling, as shown in FIG. 4, at first, the bolt 28 inserted in the lateral hole 24 is rotated by a proper tool fitting in the slot 282 counterclockwise for 180 degrees, letting the two convex faces 283 just facing respectively the two passageways 22 and 23 so that the cold and the hot water pipe 30 can be inserted in the two passageways 22 and 23, with the insert heads 32 smoothly moving in the passageways 22, 23. As the flanges 311 the two water pipes 30 are a little larger than the diameter of the passageways 22 and 23, they can be stopped by the lower end surface of the inlet base 20, with the position annular grooves 323 of the insert head 32 just facing the convex faces 283 of the bolt 28 positioned at one side of the passageways 22 and 23. Then, as shown in FIG. 5, the bolt 28 is to be rotated with a screw driver fitting in the slot 282 clockwise to let the outer wall surfaces of the convex faces 323 gradually move in the position annular grooves 323 of the two water pipes 30 to secure (or deadlock) tightly the two pipes 30 with the inlet base 20.

Figure 3:
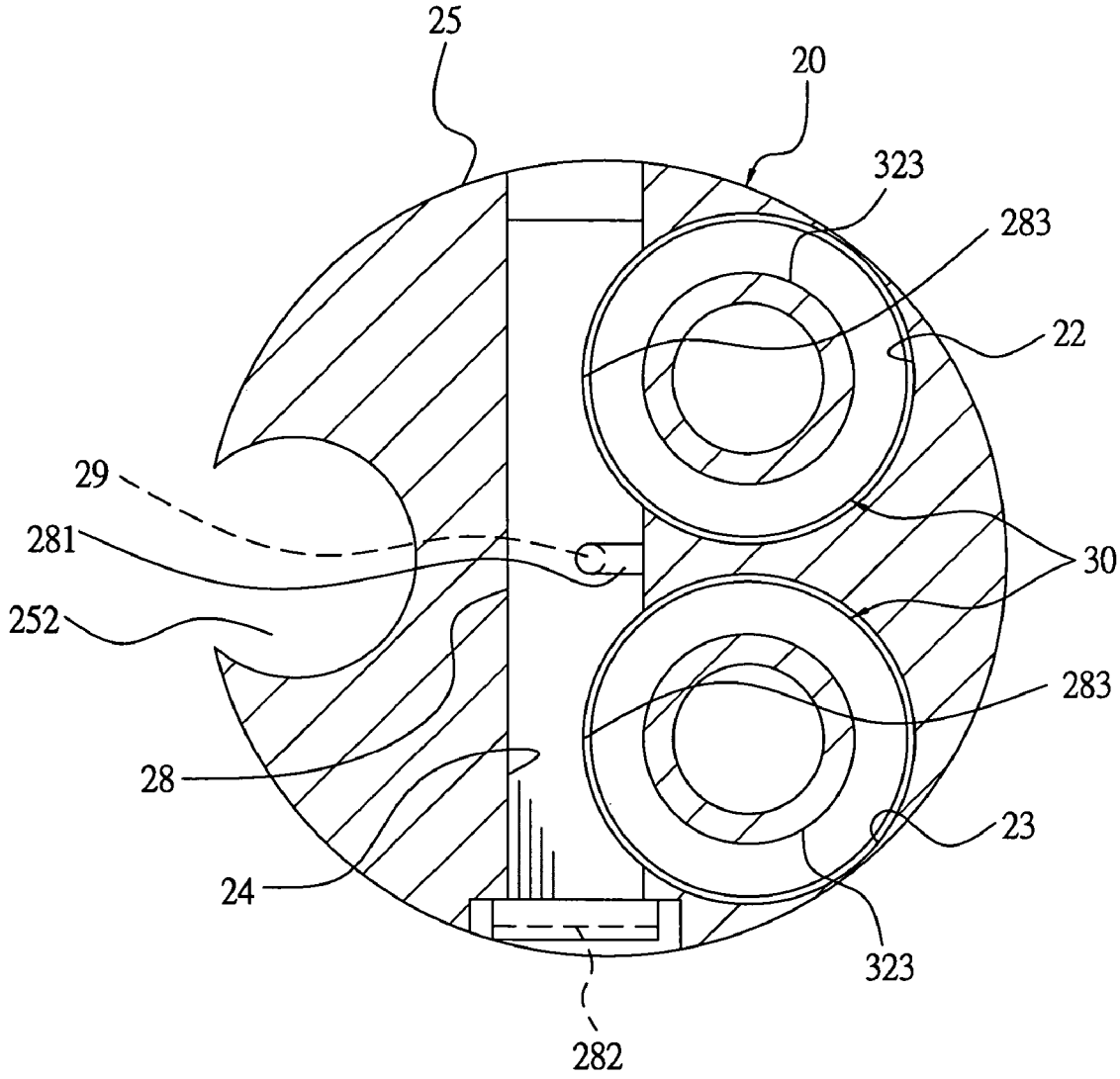
FIG. 3 is a cross-sectional view of the faucet with a cold and a hot water pipe fitted in but not yet deadlocked in the present invention.

On the contrary, if the cold and the hot water pipe 30 are to be taken off the faucet, the bolt 28 is to be rotated from the fixed position shown in FIG. 4 to the position shown in FIG. 3, with the two convex faces 283 gradually moved to face respectively the position annular grooves 323 of the two water pipes 30. Then the two water pipes 30 can be easily pulled off the two water passageways 22 and 23.

As can be seen from the above description, the faucet in the invention has a great advantage that assembly and disassembly of the two, cold and hot, water pipes 30 can be carried out with a large space and a non-obstacle mode from a side of the inlet base 20, with only a few components, and with their structure being simple, and very beneficial for manufacturing to lower its cost a little.

Figure 6:
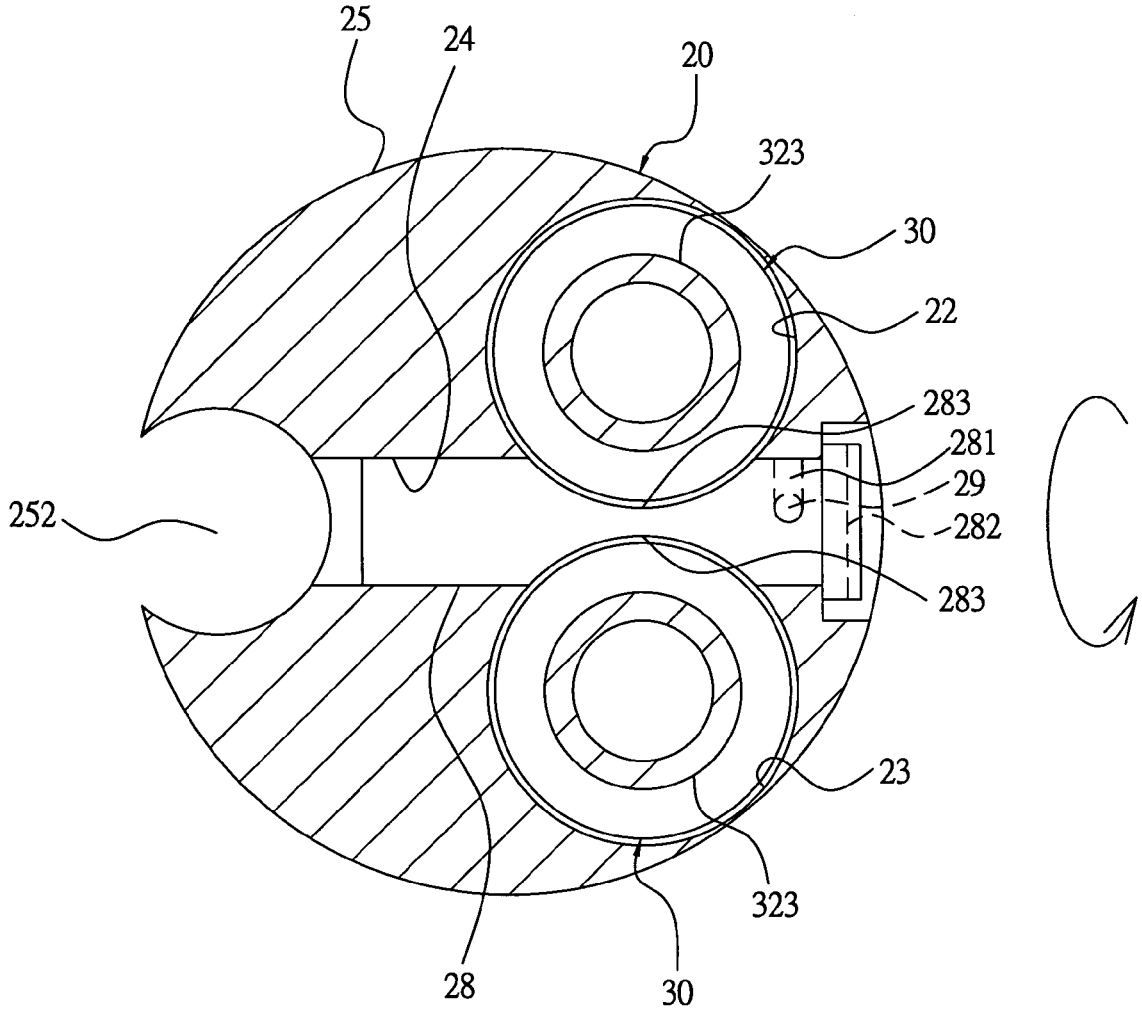
FIG. 6 is a cross-sectional view of a second embodiment of a faucet with a cold and a hot water pipe fitted in but not yet deadlocked in the present invention.
Figure 7:
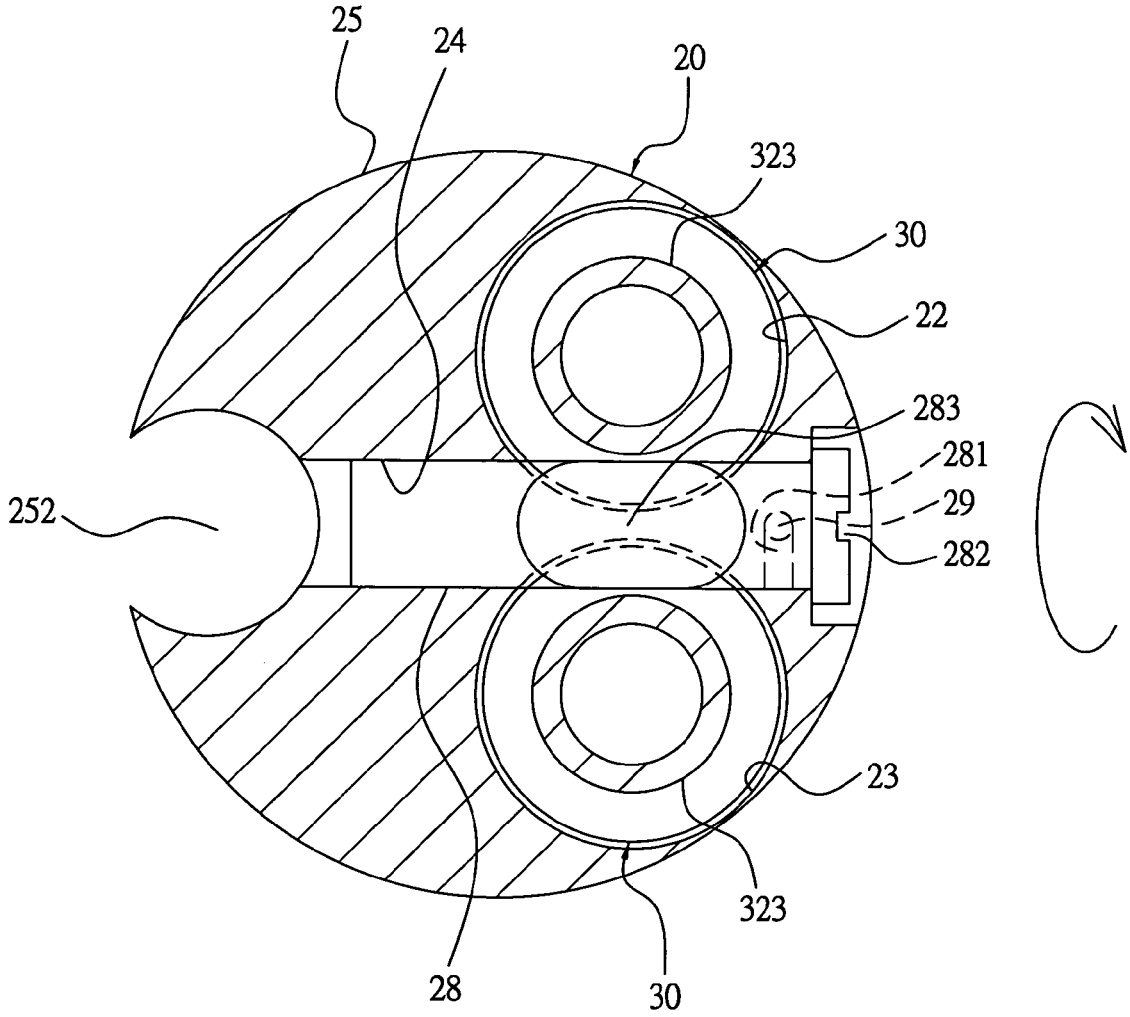
FIG. 7 is a cross-sectional view of the second embodiment of a faucet with a cold and a hot water pipe already deadlocked in the present invention; and, FIG. 8 is a cross-sectional view of another embodiment of a bolt in the present invention.

Next, as shown in FIG. 6, a second embodiment of a faucet in the invention has almost the same structure as the first embodiment except that the inlet base 20 has a lateral hole 24 located to extend between the two, cold and hot, water passageways 22 and 23, which partly communicate with the facing sides of the two water passageways 22 and 23, and the bolt 28 has two opposite convex faces 283. Then when the bolt 28 is rotated counterclockwise to let the two convex faces respectively facing the two water passageways 22 and 23, the bolt 28 completely gets out of the sphere of the two water passageways 22 and 23, with the two passageways 22 and 23 completely open to enable the cold and the hot water pipe 30 to extend in. As shown in FIG. 7, the bolt 28 is rotated for 90 degrees clockwise, the outer walls of the two convex faces 283 move in the passageways 22 and 23 and also fits in the position annular grooves 323 of the two pipes 30 to secure tightly (or deadlock) the two pipes 30 in the two passageways 22 and 23. Reversing the deadlocking process, the two pipes 30 can be taken off the faucet.

Figure 8:
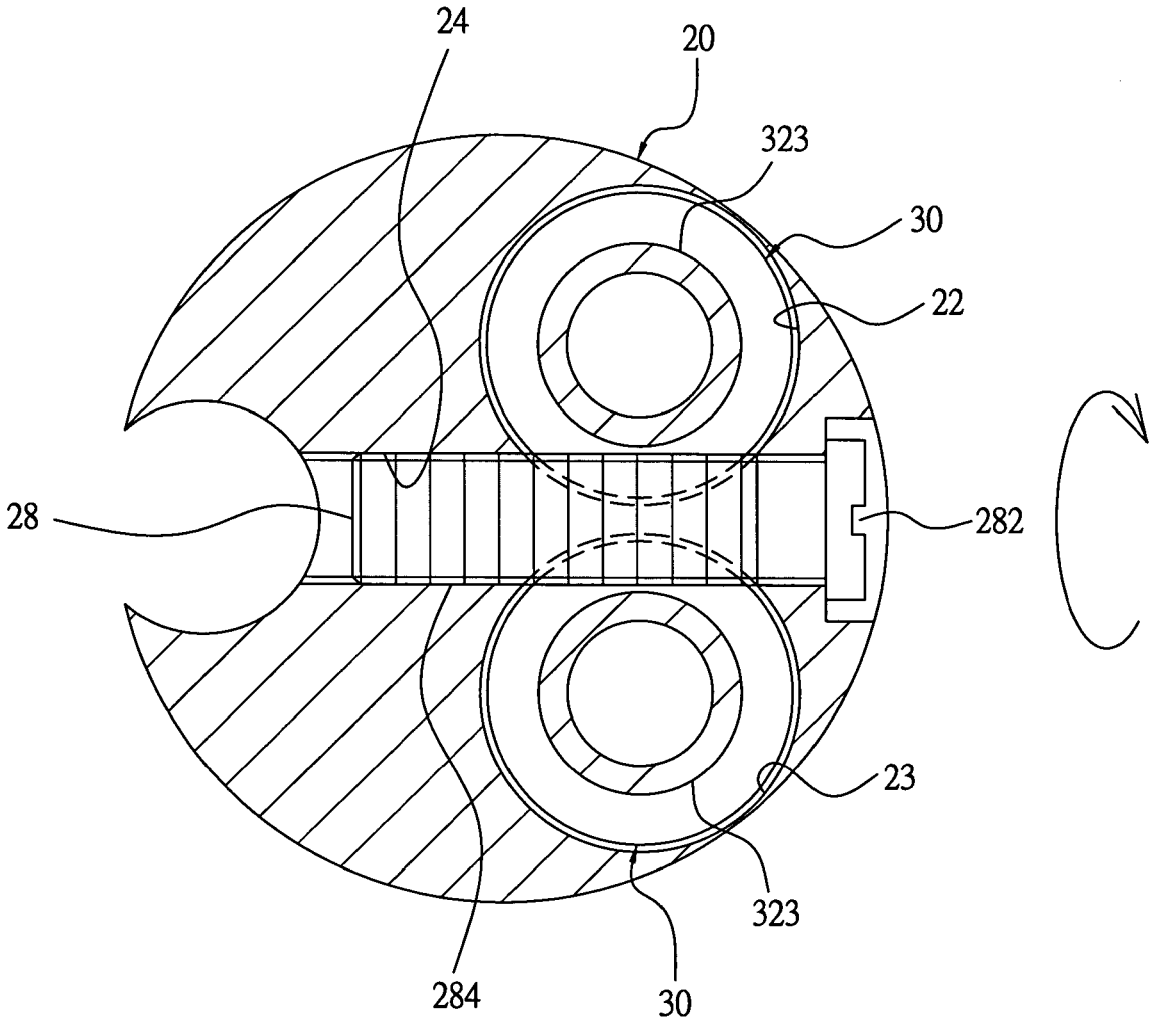

Next, FIG. 8 shows another embodiment of a bolt 28, which also has male threads and a slot 282 in an end face of the head. Then the lateral hole 24 of the inlet base 20 is female threaded to screw with the male threads of the bolt 28 so that the bolt 28 may extend in or move out of the lateral hole 24 by screwing. When the bolt 28 moves out of the lateral hole 24, the cold and the hot water pipe 30 can be inserted in or pulled out of the cold and the hot passageway 22 and 23. In case the cold and the hot water pipe 30 are inserted in the two water passageways 22 and 23, the bolt can be screwed in the lateral hole 24 deep enough to let the threaded portion fitting in the position annular groove 323 of the cold and the hot water pipe 30 to deadlock the two pipes 30 immovable in place. There fore, the two water pipes 30 can be quickly assembled with or disassembled from the inlet base 20 with easiness.

While the preferred embodiments of the invention have been described above, it will be recognized and understood that various modifications may be made therein and the appended claims are intended to cover all such modifications that may fall within the spirit and scope of the invention.

What is claimed is:

1. A faucet with a connecting structure with a cold and a hot water pipe, said faucet comprising:

an inlet base formed in a lower portion of said faucet, having an upper disc portion and a lower rod portion, said lower rod portion having a lateral hole, a vertical cold water passageway and a vertical hot water passageway for a cold water pipe and a hot water pipe respectively to extend therein, said lateral hole communicating in a preset depth with an inner wall of said cold and said hot water passageway;

a bolt extending in said lateral hole of said inlet base for deadlocking or releasing said cold and said hot water pipe; and said cold and said hot water pipe having an inner end formed with an insert head, said insert head having a position annular groove for an outer wall of an intermediate portion of said bolt to fit in to deadlock said cold and said hot water pipe immovable in place after said cold and said hot water pipe are inserted in said cold and said hot water passageway in said inlet base.

2. The faucet as claimed in claim 1, wherein said lower rod portion of said inlet base. is provided with a threaded portion, said rod portion may be inserted in a hole of an object that said faucet is to be fixed with, said threaded portion having male threads and a vertical groove, a multi-claw-shaped gasket provided to fit around a lower end of said lower rod portion, a nut engaged with said male threads tightly and forcing said multi-claw-shaped gasket against said object.

3. The faucet as claimed in claim 2, wherein said multi-claw-shaped gasket has a plurality of claws spaced apart to extend up around the circumference of said gasket, said claws possible to push forcefully against a lower surface of said object, said gasket having a center hole and a position stud extending inward from the edge of said center hole, said position stud fitting in said vertical groove of said lower rod portion and restricting said gasket to move only axially to prevent said gasket from falling off.

4. The faucet as claimed in claim 1, wherein said lateral hole in said inlet base is perpendicular with the direction of said cold and said hot water passageway, and communicates in a proper depth with an inner wall of said cold and said hot water passageway, and said bolt is restricted in its rotating angle in said hole, having a slot in an end face of its head for a proper tool to fit in to rotate said bolt, said bolt having two convex faces spaced apart in a same side, said two convex faces positioned flush with the inner walls of said cold and said hot water passageway in case of said bolt rotated to a certain angle, said cold and said hot water pipe possible to be inserted in said cold and said hot water passageway in case of said convex faces being flush with said inner walls of said cold and said hot water passageway, outer walls of said two convex faces of said bolt possible to deadlock said two pipes in place when said bolt is rotated for a certain angle in said lateral hole after said two water pipes are inserted in place in said two water passageways.

5. The faucet as claimed in claim 1, wherein said bolt is provided with a position semi-annular groove for a pin to fit therein so that said bolt is rotatable for 180 degrees only.

6. The faucet as claimed in claim 1, wherein said lateral hole is vertical to the direction of said cold and said hot water passageway, extending in the portion between said two passageways and communicating in a proper depth with inner walls of said two water passageways, said bolt rotates only for an preset angle in said lateral hole, and said bolt has a slot in an end face of a head thereof for a proper tool to fit in to rotate said bolt and a convex face respectively in the opposite sides in an intermediate portion, said cold and said hot water pipe becoming completely open in case of said two convex faces just facing said two water passageways, said cold and said hot water pipe deadlocked in place after said bolt is rotated from the position of the complete openness of said two water passageways to the deadlocking position with the outer walls of said two convex faces pushing against the outer surfaces of said two water pipes.

7. The faucet as claimed in claim 1, wherein said bolt is provided with a position groove of 90 degrees, and a pin is inserted from under said inlet base in said position groove so that said bolt is restricted to rotate in 90 degrees only.

8. The faucet as claimed in claim 1, wherein said bolt is threaded, having a head with a slot in its end face, and said lateral hole is also threaded for said bolt to screw with, and said bolt has an intermediate portion fitting in said position annular groove of said two water pipes, deadlocking said two water pipes in place in said two water passageways after said bolt is completely screwed in said lateral hole.

9. The faucet as claimed in claim 1, wherein said cold and said hot water pipe both have their inner end formed with a constrictor and a flange below the constrictor so that said flange may be stopped by the lower end surface of said inlet base when said insert heads of said two water pipes are inserted in said two water passageways.

10. The faucet as claimed in claim 1, wherein said inert heads of said cold and said hot water pipe are provided with an annular groove above said position annular groove for fitting therein an O-shaped anti-leak ring.

* * * * *